US010147373B2

(12) United States Patent
Lin et al.

(10) Patent No.: US 10,147,373 B2
(45) **Date of Patent: *Dec. 4, 2018**

(54) DRIVING METHOD FOR DISPLAY PANEL

(71) Applicant: GIANTPLUS TECHNOLOGY CO., LTD, Miaoli County (TW)

(72) Inventors: Yu-Yen Lin, Hsinchu (TW); Hou-Hong Li, Yilan County (TW)

(73) Assignee: GIANTPLUS TECHNOLOGY CO., LTD., Miaoli County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/615,792

(22) Filed: Jun. 6, 2017

(65) Prior Publication Data

US 2018/0286334 A1 Oct. 4, 2018

(30) Foreign Application Priority Data

Mar. 29, 2017 (TW) ..... 106110494 A

(51) Int. Cl.
*G09G 3/36* (2006.01)
*G09G 3/20* (2006.01)

(52) U.S. Cl.
CPC ..... *G09G 3/3633* (2013.01); *G09G 3/2074* (2013.01); *G09G 3/36* (2013.01);
(Continued)

(58) Field of Classification Search
None
See application file for complete search history.

(56) References Cited

U.S. PATENT DOCUMENTS 7,212,183 B2 5/2007 Tobita
2004/0145551 A1 7/2004 Tobita
(Continued)

FOREIGN PATENT DOCUMENTS

CN 101283393 10/2008
CN 105206240 12/2015
(Continued)

OTHER PUBLICATIONS

Yu-Yen Lin et al., "Display Apparatus and Driving Method of Display Panel Thereof", Unpublished U.S. Appl. No. 15/352,597, filed Nov. 16, 2016.
(Continued)

*Primary Examiner* — Duane N Taylor, Jr.
(74) *Attorney, Agent, or Firm* — JCIPRNET

(57) ABSTRACT

A driving method for a display panel is provided. The display panel includes a plurality of pixel circuits arranged in an array. Each of the pixel circuits respectively includes a first switch and a second switch coupled in series. The driving method for the display panel includes following steps. Plural first pulse signals are periodically received in a de-stress mode through a control terminal of the first switch of each of the pixel circuits, where the first pulse signals include a first pulse width. Plural second pulse signals are sequentially and periodically received in the de-stress mode through a control terminal of the second switch of each of the pixel circuits, where the second pulse signals include a second pulse width, and each of the pixel circuits receives the first pulse signals and the second pulse signals at different times.

10 Claims, 6 Drawing Sheets

(52) U.S. Cl.
CPC ..... *G09G 3/3614* (2013.01); *G09G 3/3648* (2013.01); *G09G 2300/0408* (2013.01)

(56) References Cited

U.S. PATENT DOCUMENTS

| | | | | |
|---|---|---|---|---|
| 2006/0022202 | A1 | 2/2006 | Yu et al. | |
| 2008/0136983 | A1* | 6/2008 | Huang | G09G 3/3659 349/38 |
| 2009/0160850 | A1 | 6/2009 | Tsou et al. | |
| 2010/0265168 | A1 | 10/2010 | Neugebauer | |
| 2011/0181563 | A1 | 7/2011 | Tsou et al. | |
| 2012/0299899 | A1 | 11/2012 | Yamauchi | |
| 2016/0063914 | A1* | 3/2016 | Lee | G09G 3/3648 345/211 |
| 2016/0133213 | A1 | 5/2016 | Fung et al. | |
| 2016/0203762 | A1* | 7/2016 | Kim | G09G 3/3258 345/76 |
| 2017/0140724 | A1 | 5/2017 | Lin et al. | |
| 2017/0352320 | A1 | 12/2017 | Lin et al. | |

FOREIGN PATENT DOCUMENTS

| | | |
|---|---|---|
| TW | 200418074 | 9/2004 |
| TW | 201306016 | 2/2013 |

OTHER PUBLICATIONS

"Office Action of Taiwan Counterpart Application," dated Jun. 8, 2017, p. 1-p. 5.
"Search Report of Europe Related Application, Application No. 17206853.8", dated Apr. 5, 2018, p. 1-p. 10.
"Search Report of Europe Counterpart Application", dated Jul. 20, 2018, p. 1-p. 8.

* cited by examiner

DRIVING METHOD FOR DISPLAY PANEL

CROSS-REFERENCE TO RELATED APPLICATION

This application claims the priority benefit of Taiwan application serial no. 106110494, filed on Mar. 29, 2017. The entirety of the above-mentioned patent application is hereby incorporated by reference herein and made a part of this specification.

FIELD OF THE INVENTION

The invention relates to a driving technology, and more particularly, to a driving method for a display panel.

DESCRIPTION OF RELATED ART

The increasing progresses of the display technology bring great conveniences to people's daily lives, in which flat panel displays (FPDs) have become the main stream products due to the characteristics of being light and thin. In various FPDs, liquid crystal displays (LCDs) are widely used because of the advantages of high space utility rate, low power consumption, free of radiation, low electromagnetic interference, and the like.

In response to the requirement for saving power, the refresh rate of display apparatuses in some cases may be reduced to 30 Hz or lower; that is, the pixels of the display panel may not perform the screen refreshing function within a certain period of time. At this time, the gate voltages of the transistors in the pixels may, within this period of time, stay at a certain level. If said gate voltages stay at the certain level for a long time, the resultant gate bias stress of the transistors may deteriorate the display quality of the display panel. Therefore, said issue of gate bias stress need be resolved to improve the display quality of the display panel.

SUMMARY OF THE INVENTION

The invention provides a driving method for a display panel. The driving method is capable of restraining the aging effects of the switch devices in the pixel circuit, especially when the display panel is being operated in a power-on state, a power-off state, or a standby state.

In an embodiment of the invention, a driving method adapted for a display panel is provided. The display panel includes a plurality of pixel circuits arranged in an array. Each of the pixel circuits includes at least one first switch and a second switch that are coupled in series, and the driving method includes following steps. Plural first pulse signals are periodically received in a de-stress mode through a control terminal of the at least one first switch of each of the pixel circuits, wherein the first pulse signals include a first pulse width. Plural second pulse signals are sequentially and periodically received in the de-stress mode through a control terminal of the second switch of each of the pixel circuits, wherein the second pulse signals include a second pulse width, and each of the pixel circuits receives the first pulse signals and the second pulse signals at different times.

According to an embodiment of the invention, a first time interval exists between the time at which the first pulse signals are received by the pixel circuits and the time at which the second pulse signals are received by at least one of the pixel circuits.

According to an embodiment of the invention, a second time interval exists between the control terminal of the second switch of each of the pixel circuits in each row, so as to sequentially receive the second pulse signals.

According to an embodiment of the invention, a second time interval exists between the control terminal of the second switch of each of the pixel circuits in odd rows and the control terminal of the second switch of each of the pixel circuits in even rows, so as to alternately receive the second pulse signals.

According to an embodiment of the invention, the control terminal of the second switch of each of the pixel circuits simultaneously receives the second pulse signals.

According to an embodiment of the invention, the first pulse signals have a first high-level voltage and a first low-level voltage, and the step of periodically receiving the first pulse signals in the de-stress mode by the control terminal of the at least one first switch of each of the pixel circuits includes: adjusting at least one of the first high-level voltage and the first low-level voltage of the first pulse signals.

According to an embodiment of the invention, the second pulse signals have a second high-level voltage and a second low-level voltage, and the step of sequentially and periodically receiving the second pulse signals in the de-stress mode by the control terminal of the second switch of each of the pixel circuits includes: adjusting at least one of the second high-level voltage and the second low-level voltage of the second pulse signals.

According to an embodiment of the invention, the de-stress mode is applicable when the display panel is being operated in at least one of a power-on state, a power-off state, and a standby state.

According to an embodiment of the invention, the at least one first switch of each of the pixel circuits of the display panel comprises two first switches, one of the two first switches, the second switch, and the other of the two first switches are sequentially coupled in series, and the control terminal of one of the two first switches is coupled to the control terminal of the other of the two first switches.

According to an embodiment of the invention, a screen refresh rate of the display panel is smaller than or equal to 30 Hz.

In view of the above, when the display panel provided herein is being operated in at least one of the power-on state, the power-off state, and the standby state, each pixel circuit of the display panel may enable each switch device through periodically receiving plural pulse signals, so as to effectively prevent the switch devices of the pixel circuits from staying at certain bias level for a long time and further prevent the aging effects caused by the accumulated bias stress of the switch devices.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF EMBODIMENTS

The following will describe some embodiments as examples of the invention. However, it should be noted that the invention is not limited to the disclosed embodiments. Moreover, some embodiments may be combined where appropriate. The term "couple" used throughout this specification (including the claims) may refer to any direct or indirect connection means. For example, if it is described that the first device is coupled to the second device, it should be understood that the first device may be directly connected to the second device or indirectly connected to the second device through other devices or certain connection means. In addition, the term "signal" may refer to at least one current, voltage, charge, temperature, data, or one or more signals.

Figure 1:
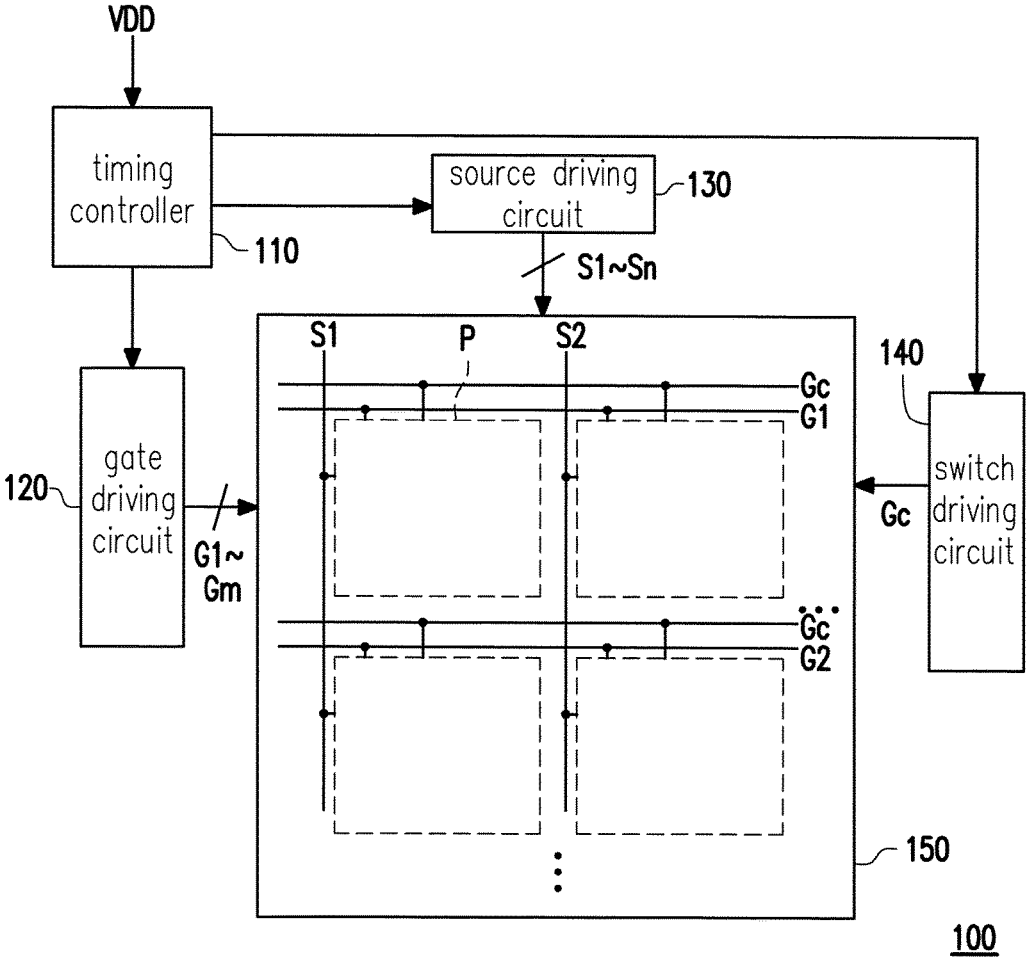
FIG. 1 is a schematic view illustrating a system of a display apparatus according to an embodiment of the invention.

FIG. 1 is a schematic view illustrating a system of a display apparatus according to an embodiment of the invention. With reference to FIG. 1, a display apparatus 100 includes a timing controller 110, a gate driving circuit 120, a source driving circuit 130, a switch driving circuit 140, and a display panel 150. The display panel 150 includes a plurality of pixel circuits P arranged in an array. Here, the display apparatus 100 may be a thin-film transistor liquid crystal display (TFT-LCD). In the present embodiment, a source signal line is arranged in each column of the pixel circuits P, and a gate signal line Gm and a common gate signal line Gc are arranged in each row of the pixel circuits P. Each switch device of the pixel circuits P may be a thin film transistor according to the present embodiment.

Here, the timing controller 110 is configured to receive an operating voltage VDD and enable the gate driving circuit 120, the source driving circuit 130, and the switch driving circuit 140. The switch driving circuit 140 outputs first driving signals to each pixel circuit P in the display panel 150 through the common gate signal lines Gc. The gate driving circuit 120 outputs a plurality of second pulse signals to each pixel circuit P in the display panel 150 through the gate signal lines G1-Gm, and m is a positive integer greater than 0. The source driving circuit 130 outputs a plurality of frame signals to each pixel circuit P in the display panel 150 through the source signal lines S1-Sn, and n is a positive integer greater than 0. In the present embodiment, the display panel 150 may be operated at a frequency with the screen refresh rate smaller than or equal to 30 Hz or operated while no frame signal is received; however, the invention is not limited thereto.

Two ways to implement the pixel circuits in the display panel are explained hereinafter with reference to FIG. 2 and FIG. 3.

Figure 2:
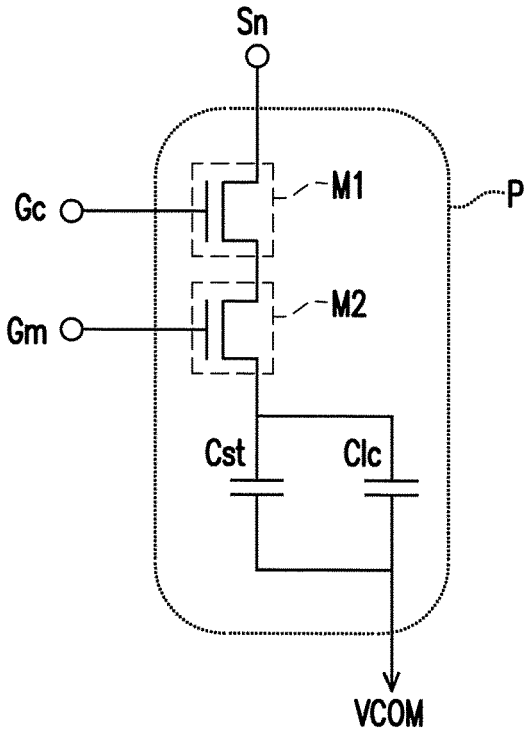
FIG. 2 is a schematic circuit diagram of a pixel circuit according to an embodiment of the invention.

FIG. 2 is a schematic circuit diagram of a pixel circuit according to an embodiment of the invention. With reference to FIG. 2, the pixel circuit P provided in the present embodiment is a dual-gate thin film transistor (TFT). The pixel circuit P includes a storage circuit Cst, a liquid crystal capacitor Clc, and a first switch M1 and a second switch M2 serially coupled to each other. The first switch M1 and the second switch M2 may be TFTs. In the present embodiment, a first terminal of the first switch M1 is coupled to the source signal line Sn. A control terminal of the first switch M1 is coupled to the common gate signal line Gc. A second terminal of the first switch M1 is coupled to a first terminal of the second switch M2. A control terminal of the second switch M2 is coupled to the gate signal line Gm. One terminal at which the storage circuit Cst and the liquid crystal capacitor Clc are serially coupled is coupled to a second terminal of the second switch M2, and the other terminal at which the storage circuit Cst and the liquid crystal capacitor Clc are serially coupled is coupled to a ground terminal VCOM. In the present embodiment, the first terminal of the first switch M1 may receive a frame signal through the source signal line Sn. The control terminal of the first switch M1 may receive the first pulse signals through the common gate signal line Gc. The control terminal of the second switch M2 may receive the second pulse signals through the gate signal line Gm.

Figure 3:
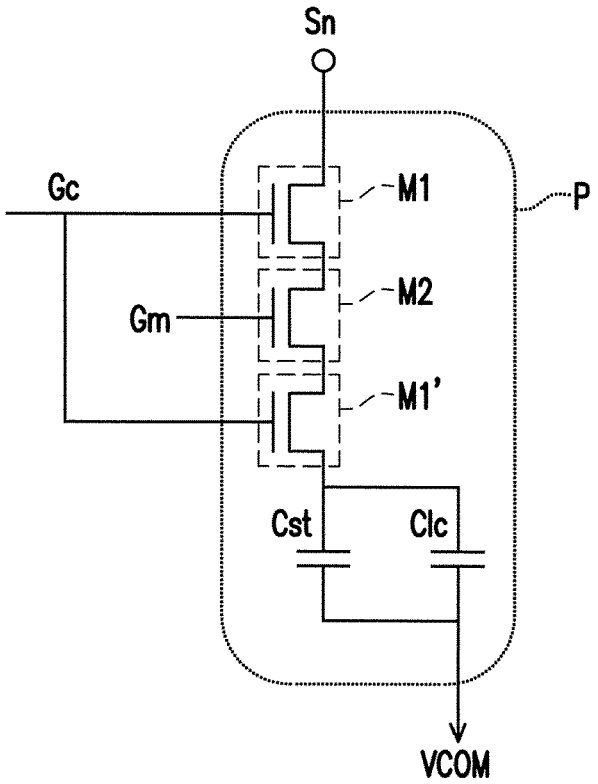
FIG. 3 is a schematic circuit diagram of a pixel circuit according to another embodiment of the invention.

FIG. 3 is a schematic circuit diagram of a pixel circuit according to another embodiment of the invention. With reference to FIG. 3, the pixel circuit P provided in the present embodiment is a triple-gate TFT. The pixel circuit P includes a storage circuit Cst, a liquid crystal capacitor Clc, two first switches M1 and M1' serially coupled to each other, and a second switch M2. The first switches M1 and M1' and the second switch M2 may be TFTs. Besides, compared to the pixel circuit with two serially coupled switch devices, the pixel circuit with three serially coupled switch devices as described in the present embodiment may contribute to the reduction of current leakage.

In the present embodiment, a first terminal of the first switch M1 is coupled to the source signal line Sn. A control terminal of the first switch M1 is coupled to the common gate signal line Gc. A second terminal of the first switch M1 is coupled to a first terminal of the second switch M2. A control terminal of the second switch M2 is coupled to the gate signal line Gm. A second terminal of the second switch M2 is coupled to the other first switch M1'. A control terminal of the other first switch M1' is also coupled to the common gate signal line Gc. One terminal at which the storage circuit Cst and the liquid crystal capacitor Clc are serially coupled is coupled to a second terminal of the other first switch M1', and the other terminal at which the storage circuit Cst and the liquid crystal capacitor Clc are serially coupled is coupled to a ground terminal VCOM. In the present embodiment, the first terminal of the first switch M1 may receive a frame signal through the source signal line Sn. The control terminals of the first switches M1 and M1' may receive the first pulse signals through the common gate signal line Gc, respectively. The control terminal of the second switch M2 may receive the second pulse signals through the gate signal line Gm.

Figure 4:
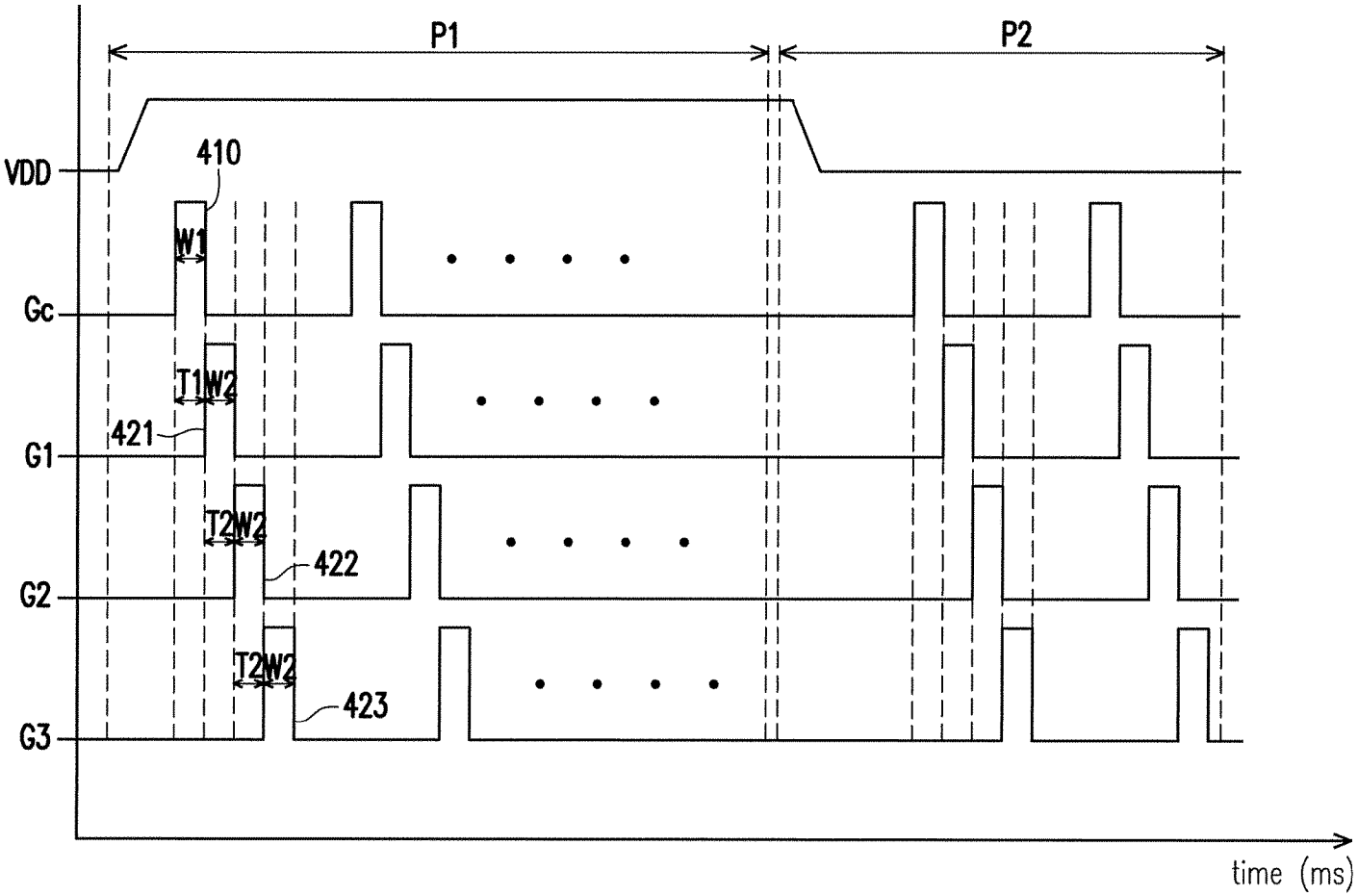
FIG. 4 illustrates signal waveforms in a de-stress mode according to an embodiment of the invention.
Figure 5:
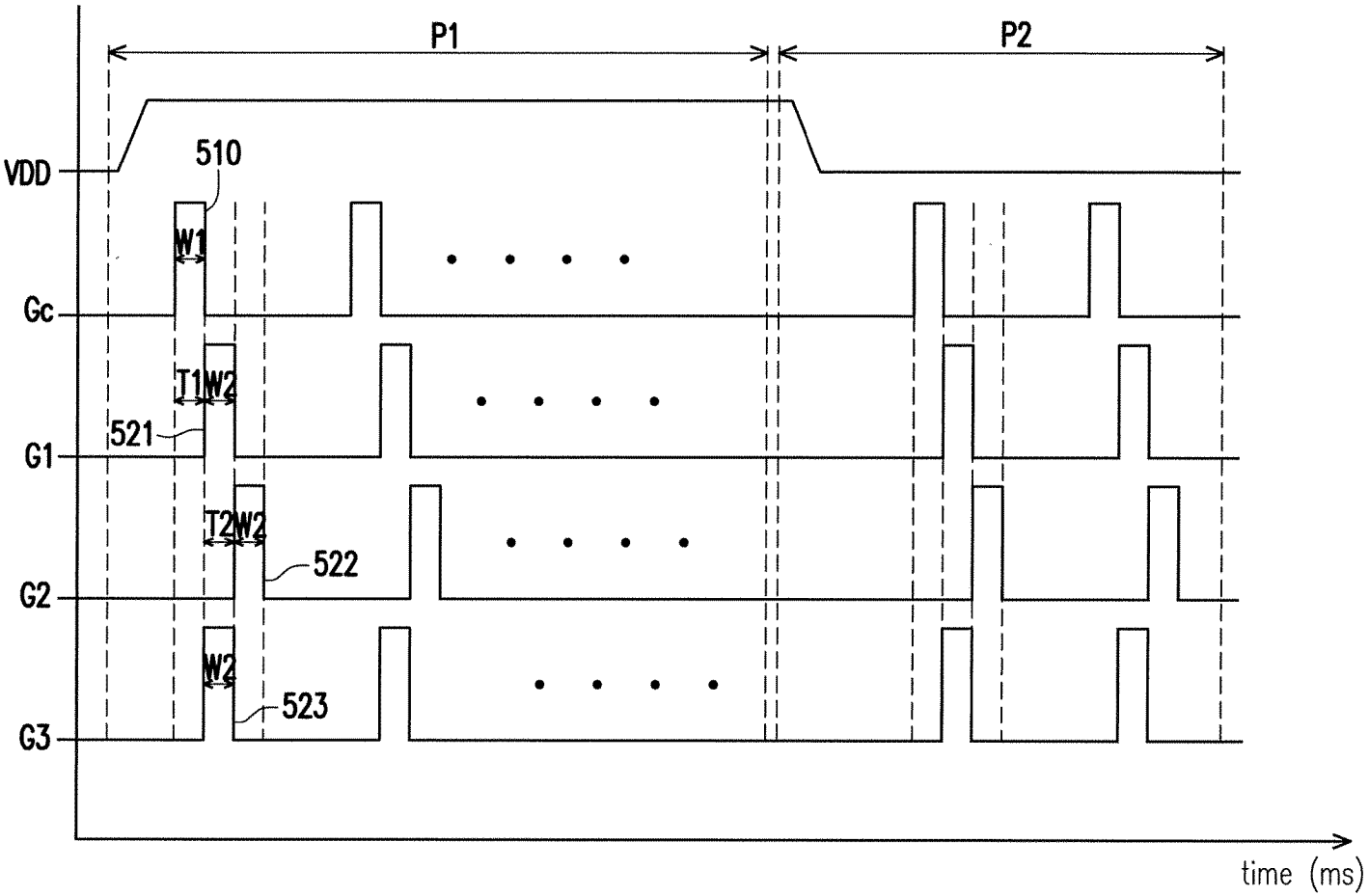
FIG. 5 illustrates signal waveforms in a de-stress mode according to another embodiment of the invention.
Figure 6:
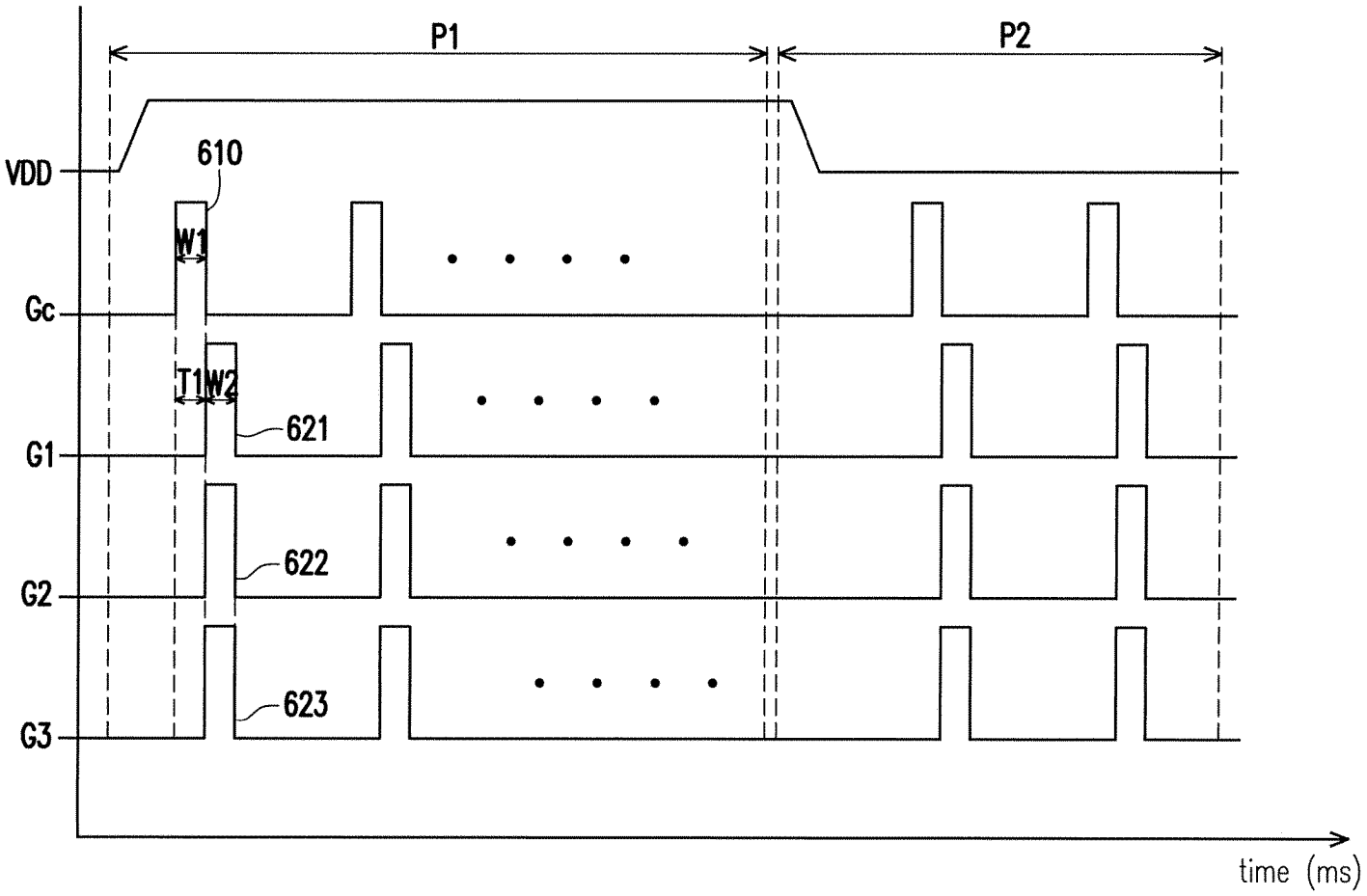
FIG. 6 illustrates signal waveforms in a de-stress mode according to still another embodiment of the invention.

FIG. 4 to FIG. 6 respectively exemplify the ways to implement the timing-control methods of the display panel in a de-stress mode, and the implementations illustrated in FIG. 4 to FIG. 6 may be applied to the pixel circuits depicted in FIG. 2 and FIG. 3; however, the invention is not limited thereto.

FIG. 4 illustrates signal waveforms in a de-stress mode according to an embodiment of the invention. With reference to FIG. 1, FIG. 3, and FIG. 4, the signal waveforms shown in FIG. 4 are applicable to the display panel 150 shown in FIG. 1 and may be applicable to the pixel circuit P shown in FIG. 3, for instance. The de-stress mode provided in the present embodiment is applicable when the display panel 150 is being operated in at least one of a power-on state, a power-off state, and a standby state (with low power consumption), for instance. That is, if the source signal lines Sn of the pixel circuits P in the display panel 150 do not receive the frame signal from the timing controller 110 or receive the frame signal at a low refresh rate, the first switches M1 and M1' and the second switch M2 of each pixel circuit P may periodically receive the pulse signals. Note that the signal waveforms are described on the condition that the pixel circuits P in three rows are provided, while the number of columns and rows in which the pixel circuits P are arranged is not limited in the present embodiment.

In the present embodiment, if the display panel 150 is being operated in the power-on state, the power-off state, or the standby state, the display panel 150 may enter the de-stress mode, and the timing controller 110 of the display panel may be turned on or off. That is, the de-stress mode provided in the present embodiment may be applied in a power-on period P1 or a power-off period P2. In the de-stress mode, the display panel 150 may periodically receive the pulse signals through the gate driving circuit 120, the switch driving circuit 140, or other driving circuits, respectively.

Specifically, during the power-on period P1, the control terminals of the first switches M1 and M1' of each pixel circuit P of the display panel 150 may receive a plurality of first pulse signals 410 through the common gate signal line Gc, such that the first switches M1 and M1' of each pixel circuit P may be periodically enabled. Besides, the control terminals of the second switches M2 of the pixel circuits P in each row may sequentially and periodically receive a plurality of second pulse signals 421, 422, and 423 through the gate signal lines G1, G2, and G3.

In the present embodiment, the pulse width W1 of the first pulse signals 410 and the pulse width W2 of the second pulse signals 421, 422, and 423 may be 0.5 ms, for instance, and the time interval T1 between the first pulse signals 410 and the second pulse signal 421 may be 1.5 ms, for instance; however, the invention is not limited thereto.

That is, when the display panel 150 is operated in the de-stress mode, the first switches M1 and M1' and the second switch M2 of each pixel circuit P of the display panel 150 may receive a plurality of pulse signals, so as to prevent the first switches M1 and M1' and the second switch M2 from staying at a certain bias level for a long time and further restrain the aging effects of the TFT caused by the bias stress. Additionally, according to the present embodiment, in the power-off period P2, the display panel 150 may receive the same pulse signal waveforms as those received in the power-on period P1, which should however not be construed as a limitation to the invention.

FIG. 5 illustrates signal waveforms in a de-stress mode according to another embodiment of the invention. With reference to FIG. 1, FIG. 3, and FIG. 5, the signal waveforms shown in FIG. 5 are applicable to the display panel 150 shown in FIG. 1 and may be applicable to the pixel circuit P shown in FIG. 3, for instance.

In comparison with the previous embodiment, during the power-on period P1, the control terminals of the first switches M1 and M1' of each pixel circuit P of the display panel 150 may receive a plurality of first pulse signals 510 through the common gate signal line Gc, such that the first switches M1 and M1' of each pixel circuit P may be periodically enabled. Besides, a time interval T2 exists between the control terminals of the second switches M2 of the pixel circuits P in odd rows and in even rows, and thus the control terminals may alternately receive the second pulse signals 521, 522, and 523 through the gate signal lines G1, G2, and G3, respectively. As a result, the second switches M2 of the pixel circuits P in odd rows and in even rows are alternately enabled.

In the present embodiment, the pulse width W1 of the first pulse signals 510 and the pulse width W2 of the second pulse signals 521, 522, and 523 may be 0.5 ms, for instance, the time interval T1 between the first pulse signals 510 and the second pulse signal 521 may be 1.5 ms, for instance, and the time interval T2 between the second pulse signals 521, 522, and 523 may be 1.5 ms as well, for instance; however, the invention is not limited thereto.

That is, when the display panel 150 is operated in the de-stress mode, the first switches M1 and M1' and the second switch M2 of each pixel circuit P of the display panel 150 may receive a plurality of pulse signals, so as to prevent the first switches M1 and M1' and the second switch M2 from staying at a certain bias level for a long time and further restrain the aging effects of the TFT caused by the bias stress. Additionally, according to the present embodiment, in the power-off period P2, the display panel 150 may receive the same pulse signal waveforms as those received in the power-on period P1, which should however not be construed as a limitation to the invention.

FIG. 6 illustrates signal waveforms in a de-stress mode according to still another embodiment of the invention. With reference to FIG. 1, FIG. 3, and FIG. 6, the signal waveforms shown in FIG. 6 are applicable to the display panel 150 shown in FIG. 1 and may be applicable to the pixel circuit P shown in FIG. 3, for instance.

Specifically, during the power-on period P1, the control terminals of the first switches M1 and M1' of each pixel circuit P of the display panel 150 may receive a plurality of first pulse signals 610 through the common gate signal line Gc, such that the first switches M1 and M1' of each pixel circuit P may be periodically enabled. Besides, the control terminal of the second switch M2 of each pixel circuit P of the display panel 150 may simultaneously receive the second pulse signals 621, 622, and 623 through the gate signal lines G1, G2, and G3, respectively. As a result, the second switches M2 of the pixel circuits P are simultaneously enabled.

In the present embodiment, the pulse width W1 of the first pulse signals 610 and the pulse width W2 of the second pulse signals 621, 622, and 623 may be 0.5 ms, for instance, and the time interval T1 between the first pulse signals 610 and the second pulse signal 621 may be 1.5 ms, for instance; however, the invention is not limited thereto.

That is, when the display panel 150 is operated in the de-stress mode, the first switches M1 and M1' and the second switch M2 of each pixel circuit P of the display panel 150 may receive a plurality of pulse signals, so as to prevent the first switches M1 and M1' and the second switch M2 from staying at a certain bias level for a long time and further restrain the aging effects of the TFT caused by the bias stress. Additionally, according to the present embodiment, in the power-off period P2, the display panel 150 may receive the same pulse signal waveforms as those received in the power-on period P1, which should however not be construed as a limitation to the invention.

The pixel circuit P shown in FIG. 3 is taken for example. The timing-control methods of the display panel in the de-stress mode as illustrated in FIG. 4 to FIG. 6 may be applied to effectively prevent the first switches M1 and M1' and the second switch M2 from staying at a certain bias level for a long time while the display panel 150 is being operated in the power-on state, the power-off state, or the standby state. Furthermore, the aging effects of the TFT caused by the bias stress may be restrained.

The first pulse signals provided in the above embodiments have a first high-level voltage and a first low-level voltage, and the second pulse signals have a second high-level voltage and a second low-level voltage. In an embodiment, the pixel circuit may further include a multiplexer or other circuit devices, and the high-level voltages and the low-level voltages of the pulse signals may be adjusted according to not only the pulse signal waveforms shown in FIG. 4 to FIG. 6 but also the specifications of the panel, the user's requirements, or other conditions.

Figure 7:
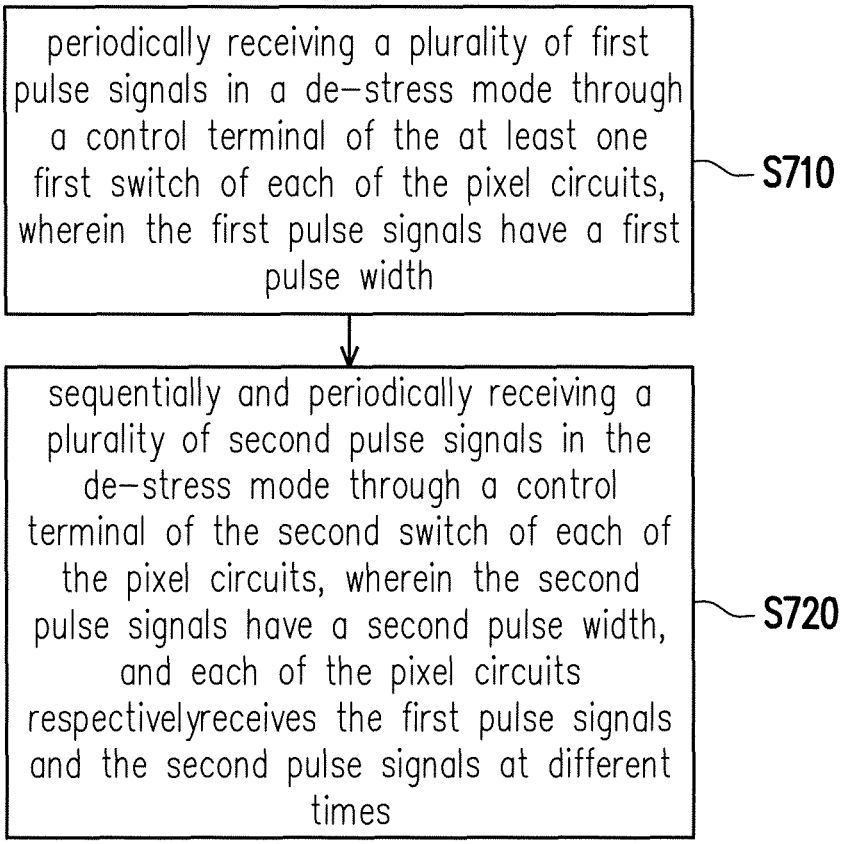
FIG. 7 is a flow chart of a driving method for a display panel according to an embodiment of the invention.

FIG. 7 is a flow chart of a driving method for a display panel according to an embodiment of the invention. The driving method provided herein is at least applicable to the display panel 150 shown in FIG. 1 and the pixel circuits P shown in FIG. 2 and FIG. 3. With reference to FIG. 1 and FIG. 7, in the present embodiment, the display panel 150 has a plurality of pixel circuits P arranged in an array, and each of the pixel circuits P includes at least one first switch and a second switch coupled in series. The driving method provided in the present embodiment includes following steps. In step S710, the display panel 150 periodically receives a plurality of first pulse signals in a de-stress mode through a control terminal of the at least one first switch of each of the pixel circuits P, wherein the first pulse signals have a first pulse width. In step S720, the display panel 150 sequentially and periodically receives a plurality of second pulse signals in the de-stress mode through a control terminal of the second switch of each of the pixel circuits P, wherein the second pulse signals have a second pulse width, and each of the pixel circuits P receives the first pulse signals and the second pulse signals at different times, respectively.

Other ways to implement the driving method of the display panel can be understood sufficiently from the teaching, suggestion, and descriptions of the embodiments illustrated in FIG. 1 to FIG. 6. Thus, details thereof are not repeated hereinafter.

To sum up, the driving method for the display panel is capable of restraining the aging effects of the switch devices in each pixel circuit when the display panel is being operated in the power-on state, the power-off state, or the standby state. That is, in the power-on state or the power-off state, each pixel circuit of the display panel may periodically provide the pulse signals to the switch devices, so as to effectively prevent the switch devices from staying at a certain bias level for a long time and further restrain the aging effects of the TFT caused by the bias stress.

It will be apparent to those skilled in the art that various modifications and variations can be made to the disclosed embodiments without departing from the scope or spirit of the invention. In view of the foregoing, it should be mentioned that the invention covers modifications and variations of this disclosure provided that they fall within the scope of the following claims and their equivalents.

What is claimed is:

1. A driving method for a display panel having a plurality of pixel circuits arranged in an array, each of the pixel circuits comprises at least one first switch and a second switch coupled in series, and comprises a storage capacitor and a liquid crystal capacitor respectively coupled to the at least one first switch and a second switch in series, the driving method comprising:

periodically receiving a plurality of first pulse signals in a de-stress mode through a control terminal of the at least one first switch of each of the pixel circuits, wherein the first pulse signals have a first pulse width; and sequentially and periodically receiving a plurality of second pulse signals in the de-stress mode through a control terminal of the second switch of each of the pixel circuits, wherein the second pulse signals have a second pulse width, and each of the pixel circuits receives the first pulse signals and the second pulse signals at different times, respectively, wherein the each of the pixel circuits does not charge or discharge the storage capacitor and the liquid crystal capacitor through a source signal line in the de-stress mode.

2. The driving method of claim 1, wherein a first time interval exists between the time at which the first pulse signals are received by the pixel circuits and the time at which the second pulse signals are received by at least one of the pixel circuits.

3. The driving method of claim 1, wherein a second time interval exists between the control terminal of the second switch of each of the pixel circuits in each row, so as to sequentially receive the second pulse signals.

4. The driving method of claim 1, wherein a second time interval exists between the control terminal of the second switch of each of the pixel circuits in odd rows and the control terminal of the second switch of each of the pixel circuits in even rows, so as to alternately receive the second pulse signals.

5. The driving method of claim 1, wherein the control terminal of the second switch of each of the pixel circuits simultaneously receives the second pulse signals.

6. The driving method of claim 1, wherein the first pulse signals have a first high-level voltage and a first low-level voltage, and the step of periodically receiving the first pulse signals in the de-stress mode by the control terminal of the at least one first switch of each of the pixel circuits comprises:

adjusting at least one of the first high-level voltage and the first low-level voltage of the first pulse signals.

7. The driving method of claim 1, wherein the second pulse signals have a second high-level voltage and a second low-level voltage, and the step of sequentially and periodically receiving the second pulse signals in the de-stress mode by the control terminal of the second switch of each of the pixel circuits comprises:

adjusting at least one of the second high-level voltage and the second low-level voltage of the second pulse signals.

8. The driving method of claim 1, wherein the de-stress mode is applicable when the display panel is being operated in at least one of a power-on state, a power-off state, and a standby state.

9. The driving method of claim 1, wherein the at least one first switch of each of the pixel circuits of the display panel comprises two first switches, one of the two first switches, the second switch, and the other of the two first switches are sequentially coupled in series, and the control terminal of one of the two first switches is coupled to the control terminal of the other of the two first switches.

10. The driving method of claim 1, wherein a screen refresh rate of the display panel is smaller than or equal to 30 Hz.

* * * * *